United States Patent [19]

Murray

[11] 4,398,599

[45] Aug. 16, 1983

[54] ROTATING BLOWOUT PREVENTOR WITH ADAPTOR

[75] Inventor: Edwin G. Murray, Odessa, Tex.

[73] Assignee: Chickasha Rentals, Inc., Midland, Tex.

[21] Appl. No.: 236,761

[22] Filed: Feb. 23, 1981

[51] Int. Cl.[3] ..... E21B 33/068; E21B 33/06

[52] U.S. Cl. ..... 166/95; 166/82; 166/84; 277/31

[58] Field of Search ..... 166/82, 84, 95; 277/31; 251/1 R

[56] References Cited

U.S. PATENT DOCUMENTS 4,154,448 5/1979 Biffle ..... 277/31

4,157,186 6/1979 Murray et al. ..... 277/31

4,293,047 10/1981 Young ..... 277/31

4,312,404 1/1982 Morrow ..... 166/84

*Primary Examiner*—James A. Leppink

*Assistant Examiner*—Hoang C. Dang

*Attorney, Agent, or Firm*—Marcus L. Bates

[57] ABSTRACT

A rotating blowout preventor apparatus includes an adaptor located at the upper end of a main body, and a rotating head assembly which is removably received by the adaptor. The adaptor is longitudinally split to provide two segmented circles which are hinged together, and which may be opened to thereby enable a very large bit to be received within the main body. The rotating head assembly is left affixed to the drill string, with the bit located in underlying position respective to the rotating head assembly. Relatively small rotating blowout preventors can accommodate extremely large drill bits by utilizing the present invention.

10 Claims, 7 Drawing Figures

ROTATING BLOWOUT PREVENTOR WITH ADAPTOR

BACKGROUND OF THE INVENTION

Drilling rigs for drilling boreholes into the ground come in all sorts of different sizes. There are very large drilling rigs used to drill below twenty thousand feet which cost thousands of dollars per day to operate. There are very small drilling rigs designed to drill four or five thousand feet into the earth which are relatively inexpensive to operate. There are many other different sizes of drilling rigs designed for drilling to depths between five thousand and twenty thousand feet. A borehole drilled with a small drilling rig costs very little per foot of depth as compared to the same borehole drilled with a large drilling rig.

In drilling a deep borehole, the first few thousand feet of the wellbore is made very large in diameter as compared to the last few thousand feet of the wellbore. It really does not matter whether a large expensive drilling rig or a small relatively inexpensive drilling rig makes the first few thousand feet of hole. However, in order for a small drilling rig to bore a large diameter wellbore, it is necessary to utilize a large drill bit. In order to pass the large drill bit down through the turntable and the rotating blowout preventor, hereinafter called a RBOP, the RBOP and turntable must have an inside diameter which will accommodate the large drill bit. Otherwise, the above surface drilling equipment must be sized much larger than would ordinarily be used in conjunction with a small drilling rig.

It would be desirable to have an adaptor for a RBOP which could accommodate a drill bit of any size so that a relatively small drilling rig could drill a very large borehole. An improved RBOP which attains this desirable goal is the subject of the present invention.

THE PRIOR ART

The previous U.S. Pat. No. 4,157,186 to Edwin and Don Murray, and U.S. Pat. No. 4,154,448 to Morris S. Biffle, and to all of the art cited therein. These patents illustrate an RBOP having a removable rotating center, and represent details of a prior art RBOP which can be advantageously used in conjunction with the present invention.

SUMMARY OF THE INVENTION

An adaptor device for use in combination with a RBOP of the type having an axial passageway for extending a rotating member therethrough. In the preferred form of the invention, the RBOP includes a lateral passageway which is in fluid communication with the lower end of the axial passageway through which drilling fluid can be returned. A removable rotating head assembly is received within the upper marginal end of the adaptor.

The lower end of the adaptor device is in the form of a main body of relatively large inside diameter which is connected to the upper end of the well casing. The lateral passageway preferably is formed into the main body. The adaptor connects the rotating head assembly to the upper end of the main body. A clamp means at the upper end of the adaptor enables the rotating head assembly to be removed therefrom.

The adaptor has a lower end, preferably in the form of a split flange, which is removably attached to the upper end of the main body, which preferably is in the form of a continuous flange. The adaptor preferably is cylindrical in form and split along its longitudinal length to provide coacting segments of a cylinder which can be pivotally joined together to provide a continuous cylinder.

The rotating head assembly telescopingly receives a rotating member therethrough, with a relatively large drill bit being positioned on the end of the rotating member. The adaptor is hingedly opened to expose the entire inner walls of the main body. The bit can be of any size up to the i.d. of the main body. The bit is telescopingly received through the main body. The adaptor is closed and secured to the main body. The clamp means secures the rotating head to the upper end of the adaptor.

Accordingly, the adaptor of the present invention, when used in combination with a suitable main body and rotating head assembly, provides a RBOP which can accept much larger drill bits than has heretofore been possible. Another unexpected advantage gained from this improved combination is the versatility imparted into a small drilling rig respective to the rig's capabilities of penetrating the earth and forming a very large diameter borehole. Hence, the adaptor enables relatively small RBOPs to be used in conjunction with relatively large drill bits.

Another unforeseen advantage of the present invention is the use of relatively small drilling rigs for forming a large upper marginal end of a relatively deep wellbore.

Accordingly, a primary object of the present invention is the provision of an adaptor which forms part of a RBOP to enable a relatively large drill bit to be used in conjunction with a relatively small RBOP.

Another object of the present invention is the provision of a method of adapting a prior art RBOP to an unusually large diameter drill bit.

A further object of the present invention is the provision of a combination of a main body, rotating head assembly, and adaptor apparatus which enables much larger drill bits to be accepted within a casing than has heretofore been possible.

Another and still further object of the present invention is the provision of an improved RBOP having an adaptor device incorporated therein by which a relatively large drill bit can be used in conjunction with a relatively small RBOP.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
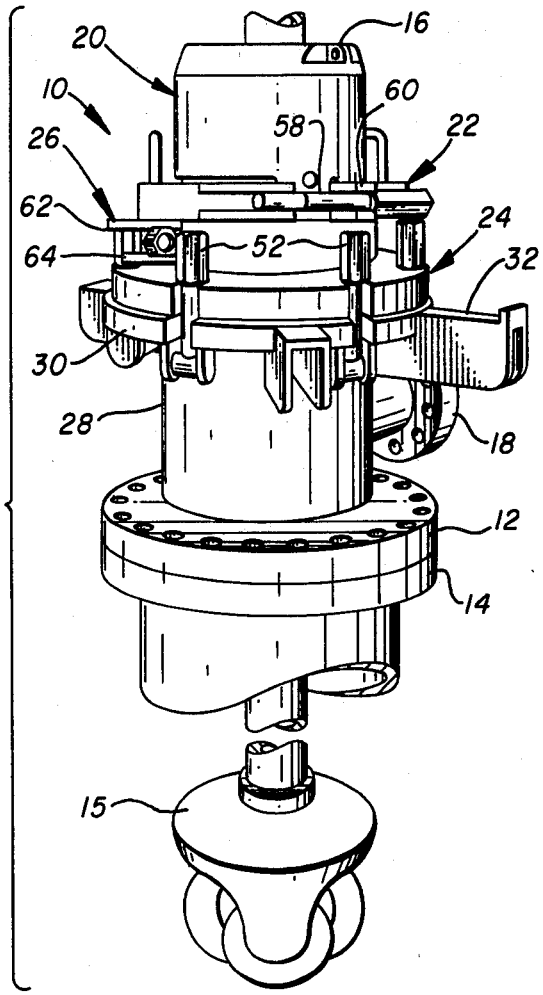
FIG. 1 is a broken, perspective view which illustrates the present invention operatively associated with a drilling operation.

In the figures of the drawings, there is disclosed a RBOP 10 made in accordance with the present invention. The RBOP includes a main body having a lower mounting flange 12 adapted to be connected to a comparable flange 14 associated with a cased borehole. Numeral 15 diagrammatically indicates a relatively large diameter drill bit which has been attached to the lower end of a rotating member which extends longitudinally through the axial passageway of the RBOP, as will be better appreciated later on as this disclosure is more fully digested.

Numeral 16 broadly indicates the upper terminal end of the RBOP assembly. A lateral passageway 18 provides communication with the lower end of the axial passageway so that drilling fluid can be returned to a mud pit, for example.

A rotating head assembly 20, made in accordance with my previous U.S. Pat. No. 4,157,186, is removably affixed by upper clamp means 22 to the upper end of an adaptor member 24, made in accordance with the present invention. The adaptor member therefore supports the rotating head assembly from the upper end thereof. Lower clamp means 26 maintains the adaptor in assembled configuration, as will be more fully discussed later on in this disclosure.

The RBOP apparatus includes a main body 28 having an upper flange 30 rigidly affixed at the upper end thereof which is opposed to the before mentioned lower flange 12. Radially spaced supports 32 have an upper face thereof which slidably receives the adaptor in supported relationship thereon when the adaptor is opened and pivotally moved horizontally away from the axial passageway, as noted in FIG. 4.

Figure 3:
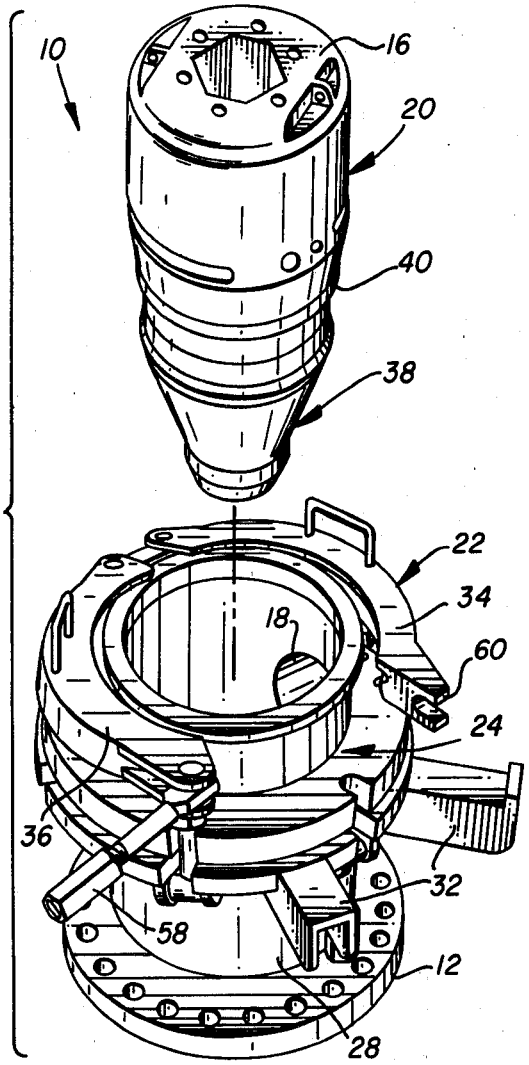
FIG. 3 is a perspective, disassembled view of the present invention.
Figure 2:
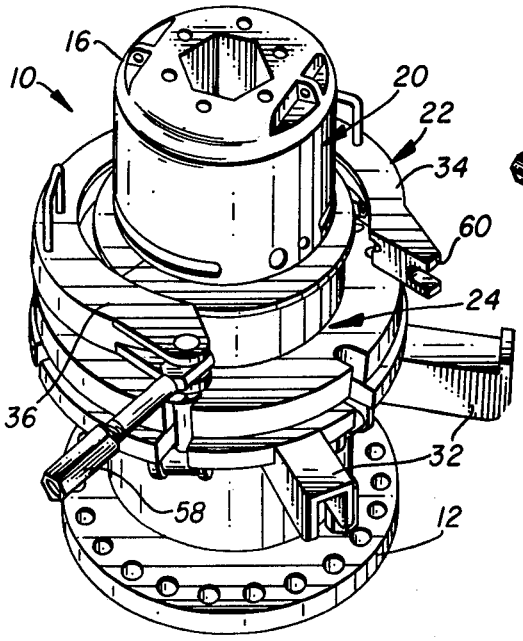
FIG. 2 is a perspective view of the apparatus shown in a different configuration.

As seen in FIG. 2, the upper clamp 22 is comprised of two confronting halves 34 and 36, hinged together at one end thereof. As seen in FIG. 3, a stripper rubber 38 is rotatably mounted to the rotating components of the rotating head assembly, and provides an annular seal within the RBOP, in a manner known to those skilled in the art. An annular seat 40 circumferentially extends about the fixed external housing of the rotating head assembly, and cooperates with clamp means 22 so that the rotating head assembly can be removably fastened to the upper extremity of the adaptor.

Figure 4:
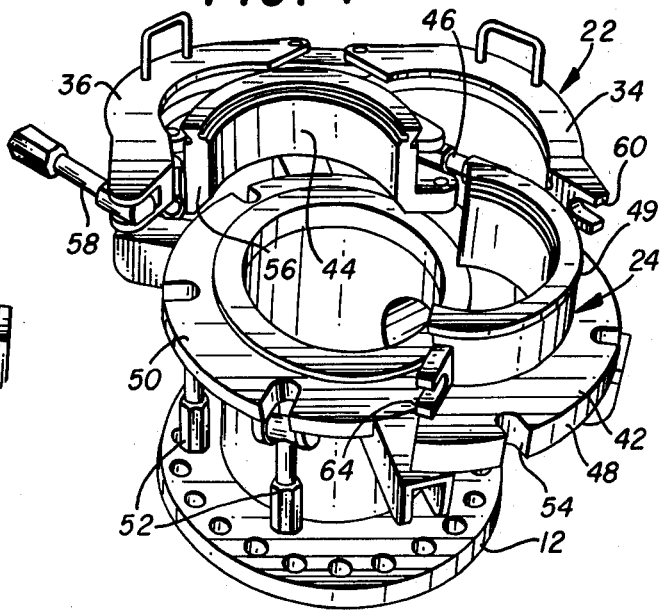
FIG. 4 is a perspective view of part of the apparatus shown in another operative configuration.
Figure 5:
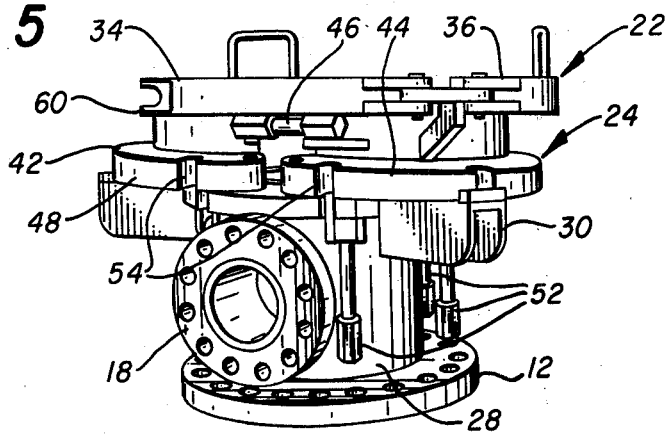
FIG. 5 is an opposite, perspective view of the apparatus disclosed in FIG. 4.

As seen in FIG. 4, both the upper and lower clamp halves have been pivoted away from one another, thereby enabling the rotating head assembly to be lifted from the adaptor and exposing the large interior of the main body to ambient. The adaptor halves 42 and 44 have been pivoted away from one another and from the axial passageway, with the outer portion of the halves being supported by the upper face of the radial support members 32. The adaptor halves are hinged at 46. The adaptor preferably includes a bisected flange 48 of annular configuration, to which there is integrally affixed an upstanding bisected cylindrical body 49. The expandable body 49 includes an external groove circumferentially disposed about the upper outer marginal end thereof for receiving a complementary circumferentially extending portion of the before mentioned clamp 22 therewithin, thereby rigidly affixing the rotating body member to the adaptor when the upper clamp is made up.

The upper flange 30 of the fixed body 28 includes an upper face 50 which slidably receives the lower face of the halves 42 and 44 of the adaptor flange when the adaptor parts are pivotally moved into abutting engagement respective to one another. Radial spaced fasteners 52 are attached to the upper fixed flange 50, and are pivotally received within the radial slots 54 of the expandable flange 42, thereby securing the adaptor to the main body. The adaptor halves each include adjacent end faces 56 resulting from bisection of the adaptor, which preferably occurs along a plane which extends along the longitudinal axial centerline of the RBOP apparatus.

The upper clamp 22 includes fastener 58 which is received within an end member 60, so that the clamp engages the annular groove 40 and the annular groove 49, respectively, of the rotating head assembly and adaptor, respectively; while the rotating housing is sealingly seated within the upper inside marginal portion of the adaptor.

Figure 6:
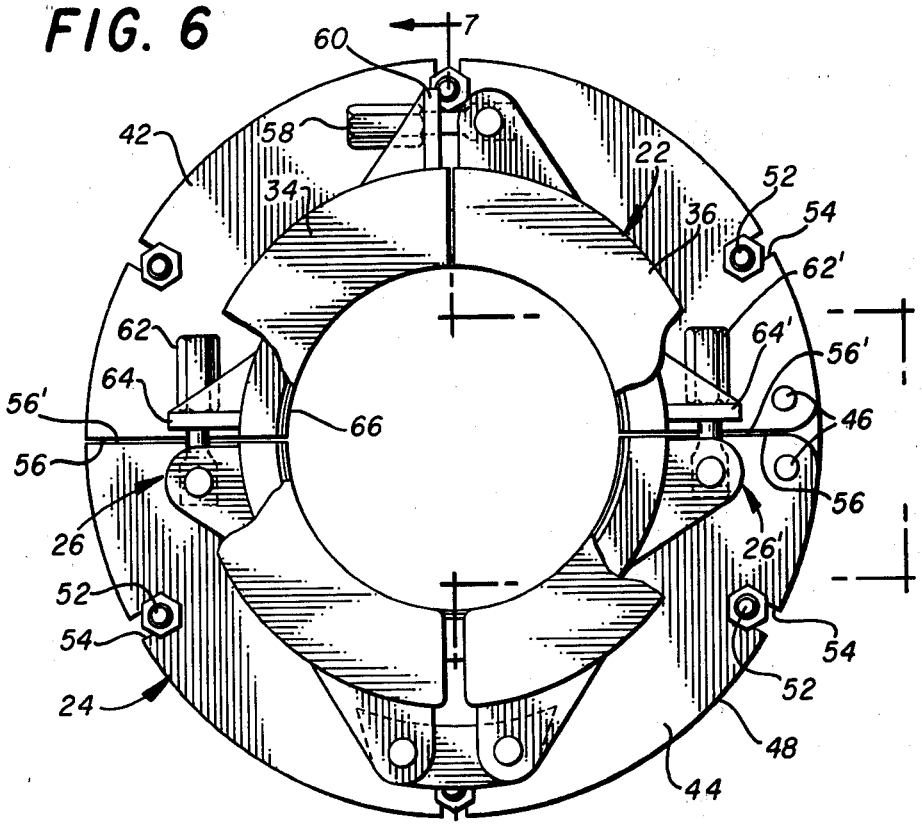
FIG. 6 is an enlarged, top, plan view of the invention, with some parts being removed therefrom, and other parts being broken away in order to better disclose the present invention; and, FIG. 7 is a cross-sectional view taken along line 7—7 of FIG. 6.
Figure 7:
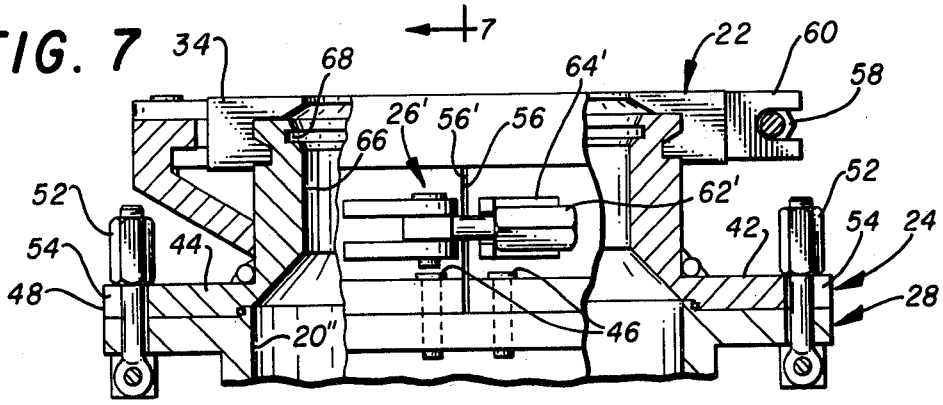

As seen in FIG. 1, together with FIGS. 6 and 7, the adaptor clamp system includes fasteners 62 and 64 which are made-up to force walls 56 and 56' of the segments into abutting and sealed engagement respective to one another.

As particularly seen in FIG. 6, the i.d. 66 of the expandable adaptor is of a size to telescopingly receive the lower marginal end of the rotating head assembly in seated relationship therewith. In FIG. 7, numeral 68 broadly indicates an annular groove which is incorporated into the adaptor, and which cooperates with a complementary annular rib which is placed on the rotating head assembly, thereby capturing the rotating head assembly within the adaptor.

In operation, the lower flange 12 of the main body is mated to a similar flange located at the upper terminal end of a cased borehole. The clamp is removed from the upper end of the adaptor, and the rotating head assembly is lifted from seated relationship therewith and temporarily stored at a remote location. The adaptor clamps and fasteners are loosened, and the adaptor segments are pivoted into the illustrated position seen in FIG. 4.

A rotating member is placed through the stripper rubber of the rotating head assembly, with a relatively large o.d. drill bit 15 being attached to the end of the drill string. The drill bit can be any size which can be received within the main body of the RBOP. The main body is of any size up to the i.d. of the casing.

The drill string, along with the drill bit, is lifted into place and lowered down through the casing while the rotating head assembly is held above the RBOP in a manner similar to FIG. 3. The segments of the adaptor are closed, the clamps and fasteners made-up, and the rotating head thereafter lowered into the illustrated position seen in FIG. 1. The upper clamp 22 is made-up, and the bit lowered down to the bottom of the borehole. The drilling operation is then carried out in the usual manner until it is necessary to replace the bit or some other part of the tool string which is too large to be forced through the stripper rubber seal.

The present invention enables any size tool to be used downhole with a relatively small RBOP, so long as the tubing which extends through the stripper rubber is of an appropriate size.

I claim:

1. In a rotating blowout preventor of the type having an axial passageway for extending a rotating member therethrough, a lateral passageway in fluid communication with the lower end of the axial passageway; and, a removable rotating head assembly which forms the upper marginal end of the rotating blowout preventor; the improvement comprising:

said rotating blowout preventor includes a main body having an upper end opposed to a lower end, and a sidewall to which said lateral passageway is affixed; mount means at the lower end of said main body by which the rotating blowout preventor can be connected to the upper end of a casing;

an adaptor having an upper end opposed to a lower end; mount means at the lower end of said adaptor by which said adaptor is removably affixed to the upper end of said main body; means at the upper end of said adaptor by which the lower marginal end of said rotating head assembly is removably affixed within the adaptor;

said adaptor is bisected by a plane which lies parallel to the axial centerline of the axial passageway, thereby leaving adjacent circumferentially extending wall members which have longitudinal edges abuttingly engaging one another to provide a closed chamber when the rotating blowout preventor is in the operative configuration; whereby, one wall member can be moved from the other wall member of the adaptor to enable a relatively large drill bit to be received through the main body, and thereby enable a relatively large drill bit to be used in conjunction with a relatively small rotating head assembly;

said adaptor has an axial passageway having a mean inside diameter which is larger respective to the axial passageway formed through the rotating head assembly and smaller respective to the axial passageway passing through the main body;

whereby; when the adaptor walls are moved apart, a drill bit having an outside diameter which does not exceed the outside diameter of the main body axial passageway can be received within the casing.

2. The improvement of claim 1 wherein said means at the upper end of said adaptor is a clamp means by which said rotating head is removably affixed to said adaptor.

3. The improvements of claim 1 wherein said adaptor is cylindrical in form and includes a split flange at the lower end thereof by which the adaptor is mounted to the upper end of the main body;

said main body includes an upper flange; said split flange and said upper flange are abuttingly received in confronting relationship to provide said mount means by which the adaptor is mounted to the main body.

4. The improvement of claim 1 wherein said means at the upper end of said adaptor is a clamp means by which said rotating head is removably affixed to said adaptor;

said adaptor is cylindrical in form and includes a split flange at the lower end thereof by which the adaptor is mounted to the upper end of the main body;

said main body includes an upper flange; said split flange and said upper flange are abuttingly received in confronting relationship to provide said mount means by which the adaptor is mounted to the main body.

5. An RBOP having a main body adapted to be affixed to the upper end of a cased borehole, a lateral outlet leading from the main body, and a rotating head assembly positioned above the main body for sealingly receiving a rotating member therethrough; the combination with said main body, rotating head assembly, and rotating member of an adaptor which enables an increased diameter drill bit to be used in conjunction therewith;

said adaptor being a segmented body which receives the rotating head in seated relationship at the upper end thereof; said adaptor includes a fastener means at the lower end thereof by which the adaptor is affixed to the upper end of the main body;

means by which the segments of said segmented body can be moved away from one another to enable a drill bit to be placed directly through said main body;

said adaptor has an axial passageway which is larger than the axial passageway formed through the rotating head assembly and smaller than the axial passageway passing through the main body;

so that when the adaptor walls are moved apart, a drill bit having an outside diameter substantially equal to the outside diameter of the main body axial passageway can be received within the well casing;

whereupon the segments can then be moved together and the rotating head mounted to the upper end of the adaptor, thereby enabling a relatively small RBOP to accommodate a relatively large bit.

6. The combination of claim 5 wherein said adaptor includes clamp means at the upper end thereof by which said rotating head is removably affixed to said adaptor.

7. The combination of claim 5 wherein said adaptor is cylindrical in form and includes a split flange at the lower end thereof by which the adaptor is mounted to the upper end of the main body;

said main body includes an upper flange; said split flange and said upper flange are abuttingly received in confronting relationship to provide said mount means by which the adaptor is mounted to the main body.

8. In a rotating blowout preventor of the type having an axial passageway for extending a rotating member therethrough, a lateral passageway in fluid communication with the lower end of the axial passageway; and, a removable rotating head assembly which forms the upper marginal end of the rotating blowout preventor; the combination with said rotating blowout preventor of an adaptor;

said rotating blowout preventor includes a main body having an upper end opposed to a lower end, and a sidewall to which said lateral passageway is affixed; mount means at the lower end of said main body by which the rotating blowout preventor can be connected to the upper end of a casing;

said adaptor includes an upper end opposed to a lower end and an axial passageway which is larger than the axial passageway of the rotating head assembly and smaller than the axial passageway of the main body; mount means at the lower end of said adaptor by which said adaptor is removably affixed to the upper end of said main body; means at the upper end of said adaptor by which the lower marginal end of said rotating head assembly is removably affixed within said adaptor;

said adaptor is bisected by a plane which lies parallel to the axial centerline of the axial passageway, thereby leaving adjacent circumferentially extending wall members which have longitudinal edges abuttingly engaging one another to provide a closed chamber when the rotating blowout preventor is in the operative configuration;

whereby, one wall member can be moved from the other wall member of the adaptor to enable a relatively large drill bit to be received through the main body, and thereby enable a relatively large drill bit to be used in conjunction with a relatively small rotating head assembly.

9. The combination of claim 8 wherein said means at the upper end of said adaptor is a clamp means by which said rotating head is removably affixed to said adaptor;

said adaptor is cylindrical in form and includes a split flange at the lower end thereby by which the adaptor is mounted to the upper end of the main body;

said main body includes an upper flange; said split flange and said upper flange are abuttingly received in confronting relationship to provide said mount means by which the adaptor is mounted to the main body.

10. The combination of claim 8 wherein said adaptor is a segmented cylinder and includes a split flange at the lower end thereof by which the adaptor is mounted to the upper end of the main body;

said main body includes an upper flange; said split flange and said upper flange are abuttingly received in confronting relationship to provide said mount means by which the adaptor is mounted to the main body.

* * * * *